US010054891B2

(12) United States Patent
Yamaguchi

(10) Patent No.: US 10,054,891 B2
(45) Date of Patent: Aug. 21, 2018

(54) PAPER FEED DEVICE AND IMAGE FORMING APPARATUS PROVIDED WITH THE SAME

(71) Applicant: KYOCERA Document Solutions Inc., Osaka (JP)

(72) Inventor: Yoshihiro Yamaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/805,931

(22) Filed: Nov. 7, 2017

(65) Prior Publication Data

US 2018/0150015 A1 May 31, 2018

(30) Foreign Application Priority Data

Nov. 28, 2016 (JP) ..... 2016-229772

(51) Int. Cl.

| | |
|---|---|
| ***B65H 1/10*** | (2006.01) |
| ***G03G 15/00*** | (2006.01) |
| ***B65H 3/06*** | (2006.01) |
| *B65H 1/26* | (2006.01) |

(52) U.S. Cl.

CPC ..... *G03G 15/6511* (2013.01); *B65H 3/06* (2013.01); *B65H 3/0607* (2013.01); *B65H 1/266* (2013.01); *B65H 2405/31* (2013.01); *B65H 2405/32* (2013.01); *B65H 2405/3231* (2013.01)

(58) Field of Classification Search

CPC ..... B65H 1/266; B65H 2405/114; B65H 2405/111; B65H 2405/31; B65H 2405/32; B65H 2405/3231

See application file for complete search history.

(56) References Cited

U.S. PATENT DOCUMENTS

2012/0205860 A1* 8/2012 Yamaguchi ..... B65H 1/04 271/157
2014/0021680 A1* 1/2014 Hamasaki ..... B65H 1/00 271/147

FOREIGN PATENT DOCUMENTS

JP 2014-156357 A 8/2014

* cited by examiner

*Primary Examiner* — Howard J Sanders
(74) *Attorney, Agent, or Firm* — Stein IP, LLC

(57) ABSTRACT

A paper feed device of the present disclosure is provided with a first cassette and a second cassette, a casing, and a support member. The first cassette and the second cassette are arranged side by side in a cassette width direction. The casing has a cassette housing portion. The support member is capable of supporting the first cassette and the second cassette. Each of the first cassette and the second cassette is provided with a pressing portion. In a state where the first cassette and the second cassette are housed, the support member is disposed at a first position retracted upward, while in a state where at least one of the first cassette and the second cassette is pulled out, the support member is pressed downward by the pressing portion so as to be disposed at a second position where the support member is contactable with an installation surface.

10 Claims, 7 Drawing Sheets

PAPER FEED DEVICE AND IMAGE FORMING APPARATUS PROVIDED WITH THE SAME

INCORPORATION BY REFERENCE

This application is based upon and claims the benefit of priority from the corresponding Japanese Patent Application No. 2016-229772 filed on Nov. 28, 2016, the entire contents of which are incorporated herein by reference.

BACKGROUND

The present disclosure relates to a paper feed device and an image forming apparatus provided with the same, and relates particularly to a paper feed device including a first cassette and a second cassette that are arranged side by side and an image forming apparatus provided with the same.

An image forming apparatus represented by a copy machine, a printer, or the like is provided with a paper feed device that houses a plurality of sheets and is used to feed paper to an image forming portion in the image forming apparatus.

Herein, for example, in a case where one image forming apparatus is shared among many users, a sheet consumption amount per image forming apparatus is increased. As a solution to this, there is known a paper feed device that is provided with a plurality of large-capacity sheet cassettes.

Such a paper feed device is provided with a first cassette and a second cassette that have a large capacity and are arranged side by side in a cassette width direction and a casing having a cassette housing portion in which the first cassette and the second cassette are housed. The casing has a pair of side surface portions that are disposed to be opposed to each other in the cassette width direction and a bottom surface portion. In the casing, there are provided a pair of outer rails that are disposed along both the side surface portions, respectively, and an inner rail that is disposed at a center portion on the bottom surface portion in the cassette width direction. The first cassette is slidably supported to one of the pair of outer rails and the inner rail, and the second cassette is slidably supported to the other of the pair of outer rails and the inner rail.

In this type of paper feed device, weights of respective outer-side portions of the first cassette and the second cassette in the cassette width direction are supported by both the side surface portions of the casing. Weights of respective inner-side portions of the first cassette and the second cassette, on the other hand, are applied to the center portion on the bottom surface portion in the cassette width direction. The bottom surface portion is flat plate-shaped and thus lacks strength to sufficiently support weights of the respective inner-side portions of the first cassette and the second cassette. For this reason, a front lower stay and a rear lower stay that extend in the cassette width direction are provided in a front end portion of the bottom surface portion (a downstream-side end portion thereof in a cassette pull-out direction) and a rear end portion of the bottom surface portion (an upstream-side end portion thereof in the cassette pull-out direction), respectively, so that the inner rail is supported by the front lower stay and the rear lower stay.

SUMMARY

A paper feed device according to one aspect of the present disclosure is provided with a first cassette and a second cassette, a casing, and a support member. The first cassette and the second cassette each house a plurality of sheets in a stacked state and are arranged side by side in a cassette width direction. The casing has an opening portion through which the first cassette and the second cassette are inserted/drawn out and a cassette housing portion in which the first cassette and the second cassette are housed. The support member is disposed at a center portion of the opening portion in the cassette width direction and is capable of supporting the first cassette and the second cassette. The casing has a stay that is disposed in a lower portion of the opening portion and extends in the cassette width direction. Each of the first cassette and the second cassette is provided with a pressing portion that presses the support member downward. The support member is movable in an up-down direction, and in a state where the first cassette and the second cassette are housed in the cassette housing portion, the support member is disposed at a first position retracted upward, while in a state where at least one of the first cassette and the second cassette is pulled out from the cassette housing portion, the support member is pressed downward by the pressing portion so as to be disposed at a second position where the support member is contactable with an installation surface on which the casing is installed.

Still other objects of the present disclosure and specific advantages provided by the present disclosure will be made further apparent from the following description of an embodiment.

DETAILED DESCRIPTION

With reference to the appended drawings, the following describes an embodiment of the present disclosure.

Figure 1:
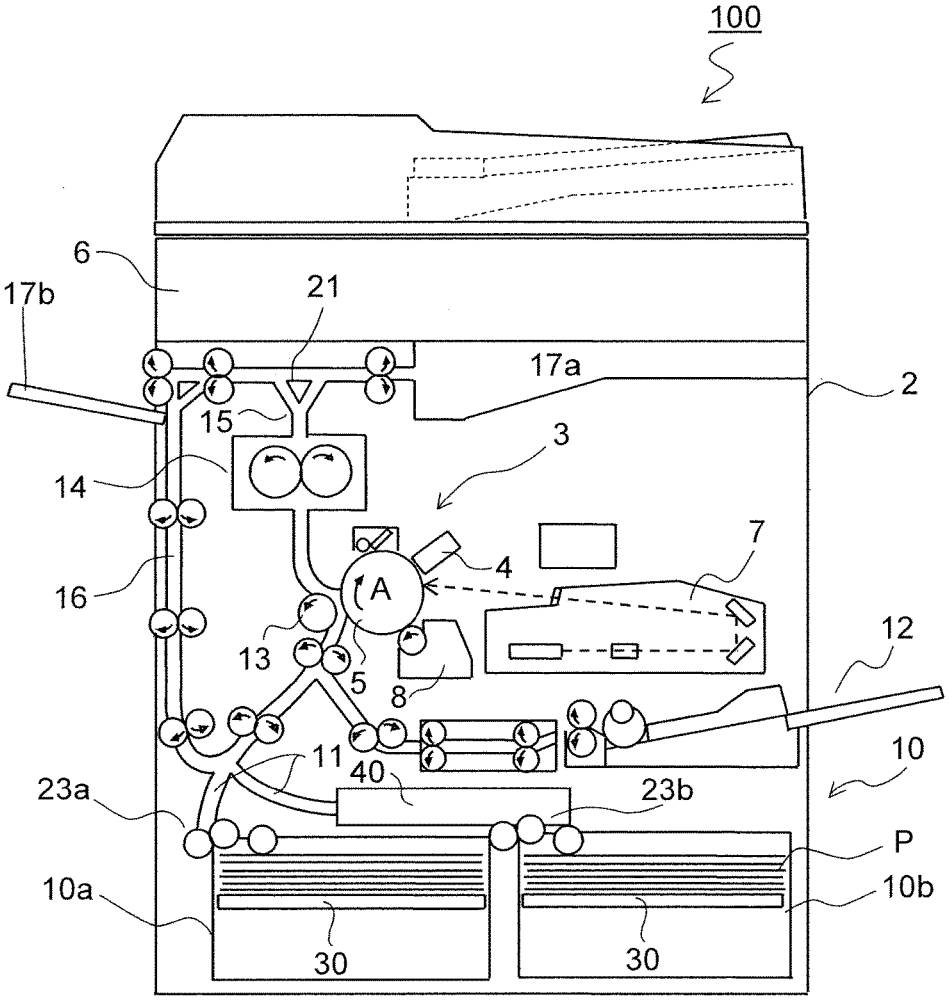
FIG. 1 is a schematic configuration view of an image forming apparatus provided with a paper feed device according to one embodiment of the present disclosure, as seen from an apparatus rear surface side.

FIG. 1 is a schematic configuration view of an image forming apparatus 100 provided with a paper feed device 10 according to one embodiment of the present disclosure, as seen from an apparatus rear surface side. First, with reference to FIG. 1, a description is given of a configuration and an operation of the image forming apparatus 100 (herein, a digital multi-functional peripheral) provided with the paper feed device 10.

In FIG. 1, in the image forming apparatus 100, in a case of performing a copy operation, in an image reading portion 6 that is disposed in an upper portion of a multi-functional peripheral main body 2, image data of an original document is read and converted into a read image signal. Meanwhile, in an image forming portion 3 in the multi-functional peripheral main body 2, a photosensitive drum 5 that rotates in an A direction in the figure is uniformly charged by a charging unit 4, and on the photosensitive drum 5, an electrostatic latent image is formed by a laser beam from an exposure unit 7, which is based on the image data of the original document read in the image reading portion 6. Further, by a developing unit 8, a developer (hereinafter, referred to as toner) is made to adhere to the electrostatic latent image, and thus a toner image is formed.

Furthermore, the paper feed device 10 is disposed in a lower portion of the multi-functional peripheral main body 2, and toward the photosensitive drum 5, on which the toner image has been formed as described above, a sheet (a paper sheet) P is conveyed from the paper feed device 10 to the image forming portion 3 via a sheet conveyance path 11 and a registration roller pair. Then, in the image forming portion 3, the toner image on a surface of the photosensitive drum 5 is transferred onto the sheet P by a transfer roller 13. The sheet P, onto which the toner image has been transferred, is conveyed to a fixing portion 14 at which the toner image is fixed. A conveyance direction of the sheet P, which has passed through the fixing portion 14, is controlled by a path switching mechanism 21 that is provided at a bifurcation point of a sheet conveyance path 15 so that the sheet P is directly (or after being sent to a sheet conveyance path 16 and then subjected to double-sided copying) ejected to a sheet ejection portion composed of a first ejection tray 17*a* and a second ejection tray 17*b*.

The paper feed device 10 is demountably mounted to the multi-functional peripheral main body 2 and provided with a first cassette 10*a* and a second cassette 10*b* that each house sheets. A stack bypass (a manual feed tray) 12 is provided above the second cassette 10*b* . The first cassette 10*a* , the second cassette 10*b* , and the stack bypass 12 are linked via the sheet conveyance path 11 to the image forming portion 3 composed of the photosensitive drum 5, the developing unit 8, and so on.

The first cassette 10*a* and the second cassette 10*b* are disposed in a row (arranged side by side to each other) in a lateral direction. Furthermore, in each of the first cassette 10*a* and the second cassette 10*b* , a lift plate 30 is provided that can reciprocate in an up-down direction, and the sheet (the paper sheet) P stacked on the lift plate 30 is pressed against a pick-up roller of a corresponding one of paper feed mechanisms 23*a* and 23*b* by the lift plate 30 and thus is fed to the sheet conveyance path 11.

The paper feed mechanisms 23*a* and 23*b* are provided so as to correspond to the first cassette 10*a* and the second cassette 10*b* , respectively, and feed out the sheet P in the first cassette 10*a* and the sheet P in the second cassette 10*b* , respectively.

Furthermore, the paper feed device 10 further has a horizontal conveyance unit 40 that conveys, in a substantially horizontal direction, the sheet P fed out from the second cassette 10*b* by the paper feed mechanism 23*b*.

Next, with reference to FIG. 1 to FIG. 11, a more detailed description is given of the paper feed device 10 according to one embodiment of the present disclosure.

Figure 2:
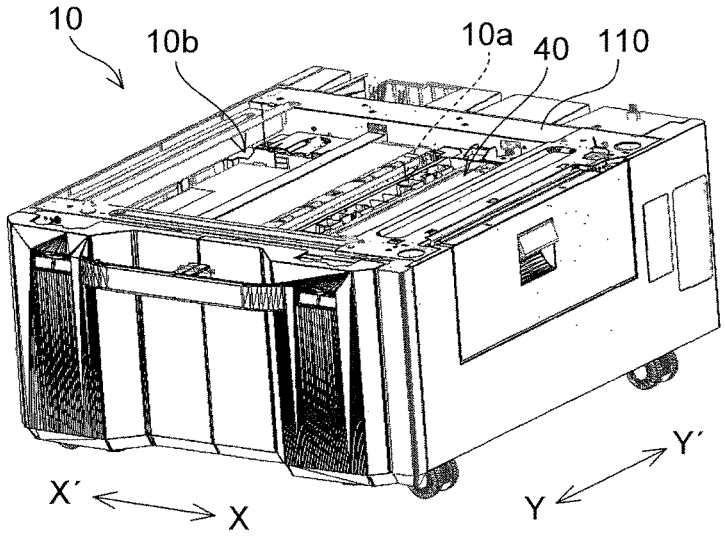
FIG. 2 is a perspective view showing a structure of the paper feed device of one embodiment of the present disclosure.
Figure 3:
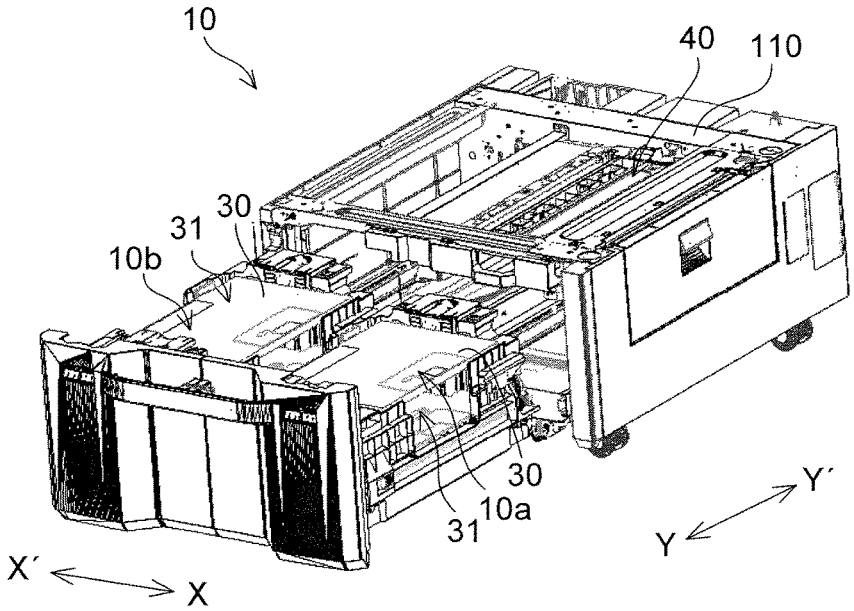
FIG. 3 is a perspective view showing a structure of the paper feed device of one embodiment of the present disclosure, which illustrates a state where a first cassette and a second cassette are pulled out.

As shown in FIG. 2 and FIG. 3, the paper feed device 10 is provided with the first cassette 10*a* and the second cassette 10*b* , the paper feed mechanisms 23*a* and 23*b* (see FIG. 1), the horizontal conveyance unit 40, and a casing 110 that houses and retains these components.

The first cassette 10*a* and the second cassette 10*b* are similar in configuration to each other and arranged side by side so that their respective sheet conveyance directions are in the same direction (an arrow X direction in FIG. 2). As for the second cassette 10*b* , the sheet P fed therefrom needs to pass above the first cassette 10*a* , and thus the second cassette 10*b* is disposed to be slightly higher in level than the first cassette 10*a* . In the casing 110 of the paper feed device 10, the first cassette 10*a* and the second cassette 10*b* are housed so as to be able to be pulled out, and they can be inserted/drawn out in a front-rear direction (an arrow YY' direction).

Furthermore, each of the first cassette 10*a* and the second cassette 10*b* is of a large-capacity type that can house 1,000 or more sheets (paper sheets) P and has a sheet housing portion 31 in which a large number of sheets P are housed in a stacked state. The first cassette 10*a* and the second cassette 10*b* are replenished with the sheets P from an upper side of the sheet housing portion 31. In the drawings, there is shown a state where no sheets P are housed, and the lift plate 30 is, therefore, disposed at an uppermost position.

Figure 4:
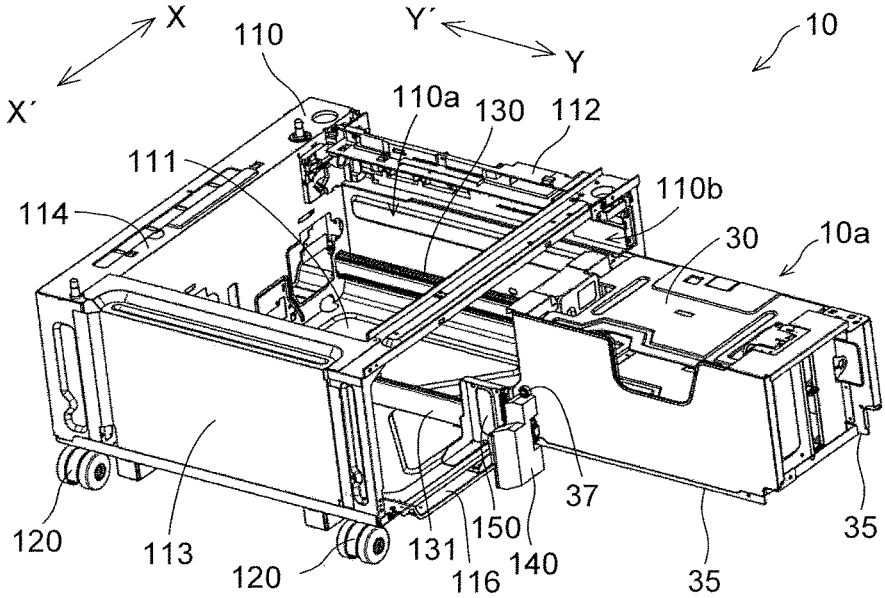
FIG. 4 is a perspective view showing a structure of the paper feed device of one embodiment of the present disclosure, which illustrates a state where the first cassette is pulled out.
Figure 5:
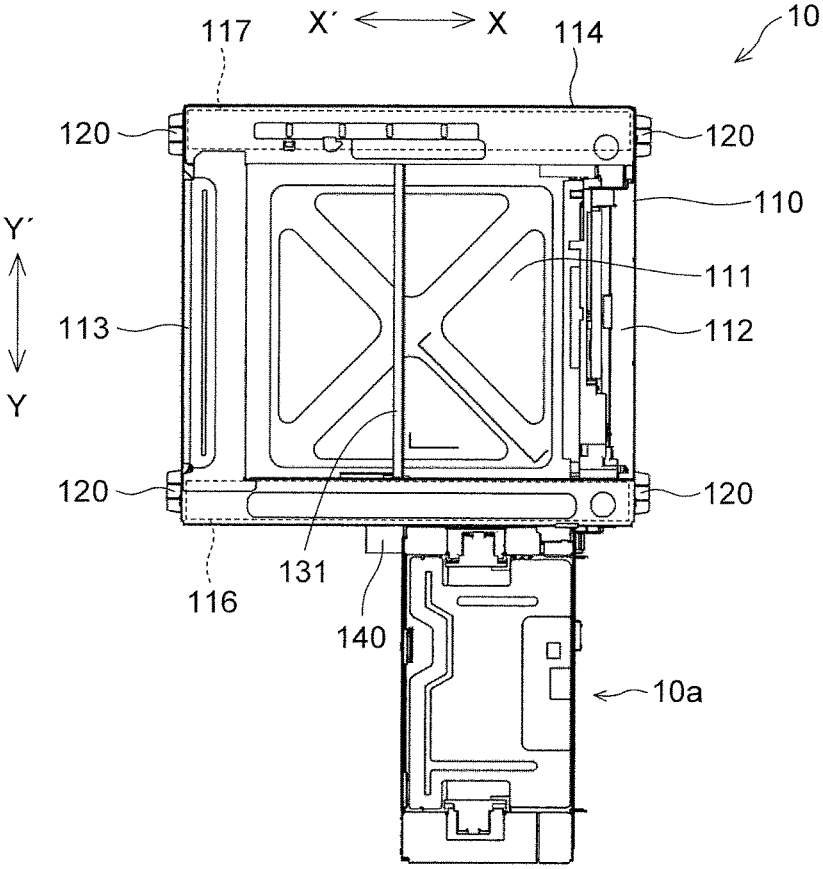
FIG. 5 is a plan view showing a structure of the paper feed device of one embodiment of the present disclosure, which illustrates the state where the first cassette is pulled out.

As shown in FIG. 4, the casing 110 is provided with a bottom surface portion 111, a pair of side surface portions 112 and 113 that are disposed to be opposed to each other in a cassette width direction (an arrow XX' direction), and a rear surface portion 114, and these components constitute a cassette housing portion 110*a* that houses the first cassette 10*a* and the second cassette 10*b* . In each of FIG. 4 to FIG. 11, for easier understanding, the second cassette 10*b* , the horizontal conveyance unit 40, and so on are omitted.

In a front surface portion of the casing 110, an opening portion 110*b* is formed through which the first cassette 10*a* and the second cassette 10*b* pass when inserted/drawn out. In a lower portion of the opening portion 110*b* (an end portion of the bottom surface portion 111 on a downstream side (an arrow Y direction) in a pull-out direction), a front lower stay (a stay) 116 is provided that extends in the cassette width direction and is joined to the pair of side surface portions 112 and 113. In an end portion of the bottom surface portion 111 on an upstream side (an arrow Y' direction) in the pull-out direction, a rear lower stay 117 (see FIG. 5) is provided that extends in the cassette width direction and is joined to the pair of side surface portions 112 and 113. A caster 120 that movably supports the paper feed device 10 is mounted to each of four corners of the casing 110 in a lower portion thereof.

At a lower portion of the side surface portion 112, an outer rail 130 is secured that extends in a cassette insertion/drawing-out direction (the arrow YY' direction), and at a center portion of the bottom surface portion 111 in the cassette width direction (the arrow XX' direction), an inner rail 131 is secured that extends in the cassette insertion/drawing-out direction.

In lower portions of the first cassette 10*a* on both ends thereof in the cassette width direction, a pair of sliding portions 35 are provided that are slidably supported by the outer rail 130 and the inner rail 131. Accordingly, a weight of a portion of the first cassette 10*a* on an outer side (the arrow X direction) in the cassette width direction is supported by the side surface portion 112 via the outer rail 130. A weight of a portion of the first cassette 10*a* on an inner side (an arrow X' direction) in the cassette width direction is supported by the front lower stay 116 and the rear lower stay 117 (see FIG. 5) via the inner rail 131. As will be mentioned later, in a state where the first cassette 10*a* is pulled out (a state where pulling-out thereof is completed, a state shown in FIG. 4 and FIG. 6), a weight of the portion of the first cassette 10*a* on the inner side (the arrow X' direction) is supported by an after-mentioned support member 140.

The second cassette 10*b* (see FIG. 3) is configured similarly to the first cassette 10*a* . That is, a pair of sliding portions 35 are provided in lower portions of the second cassette 10*b* on both ends thereof in the cassette width direction, and by an outer rail 130 secured at a lower portion of the side surface portion 113 and the inner rail 131 secured at the center portion of the bottom surface portion 111 in the cassette width direction (the arrow) XX' direction), the second cassette 10*b* is supported so as to be able to be inserted/drawn out.

Figure 6:
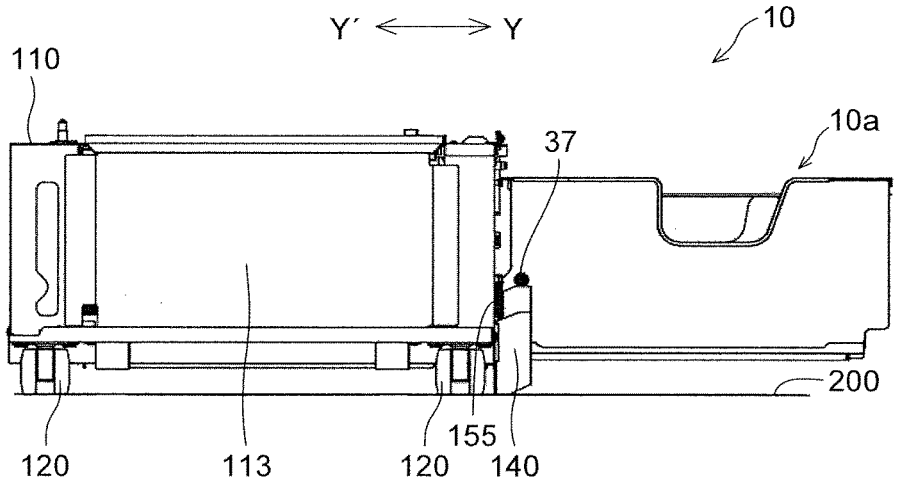
FIG. 6 is a side view showing a structure of the paper feed device of one embodiment of the present disclosure, which illustrates the state where the first cassette is pulled out.

As shown in FIG. 4 and FIG. 6, in the paper feed device 10, the support member 140 is provided that can support the first cassette 10*a* and the second cassette 10*b* . The support member 140 is configured to be movable in the up-down direction. Furthermore, in a state where at least one of the first cassette 10*a* and the second cassette 10*b* is pulled out (the state shown in FIG. 4 and FIG. 6), the support member 140 is pressed downward by a pressing portion 37 of the pulled-out at least one of the cassettes (the first cassette 10*a* , the second cassette 10*b* ) so as to come into contact with a floor surface 200 (an installation surface on which the paper feed device 10 is installed) and thus supports the pulled-out at least one of the cassettes.

Figure 7:
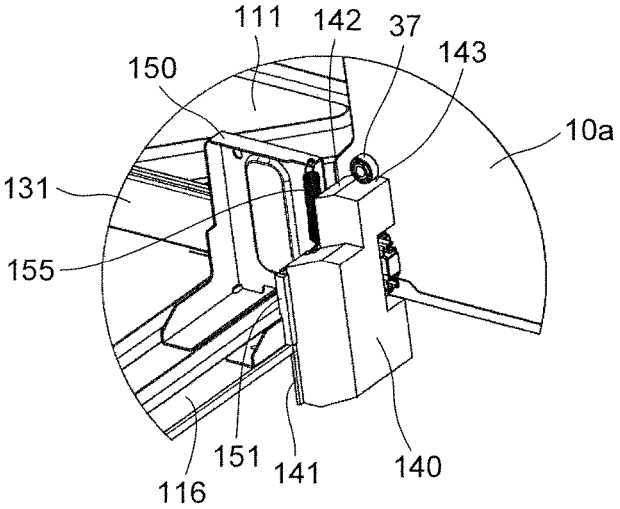
FIG. 7 is a perspective view showing a structure in a vicinity of a support member of the paper feed device of one embodiment of the present disclosure in the state where the first cassette is pulled out.

A specific description is given below. As shown in FIG. 4 and FIG. 7, at the center portion of the opening portion 110*b* in the cassette width direction, a guide member 150 is provided that guides the support member 140 so that the support member 140 is movable in the up-down direction. That is, at the center portion of the opening portion 110*b* in the cassette width direction, the support member 140 is disposed between the first cassette 10*a* and the second cassette 10*b* . The guide member 150 is secured to the front lower stay 116. The inner rail 131 may be secured to the guide member 150.

Figure 8:
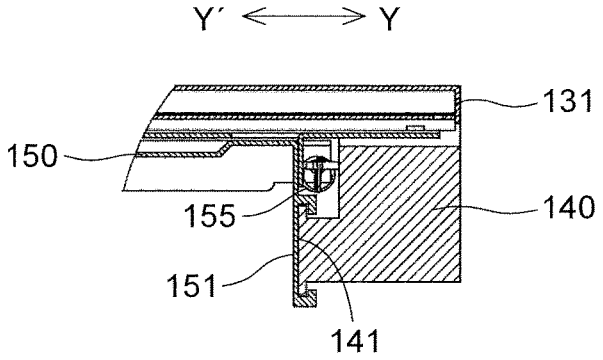
FIG. 8 is a plan sectional view showing a structure in a vicinity of the support member and a guide member of the paper feed device of one embodiment of the present disclosure.

As shown in FIG. 7 and FIG. 8, in the guide member 150, a guide portion 151 that is U-shaped in cross section is formed to extend in the up-down direction. In the support member 140, a sliding portion 141 is formed that slides in the up-down direction with respect to the guide portion 151. Thus, the support member 140 is movable in the up-down direction while being guided by the guide member 150.

Figure 9:
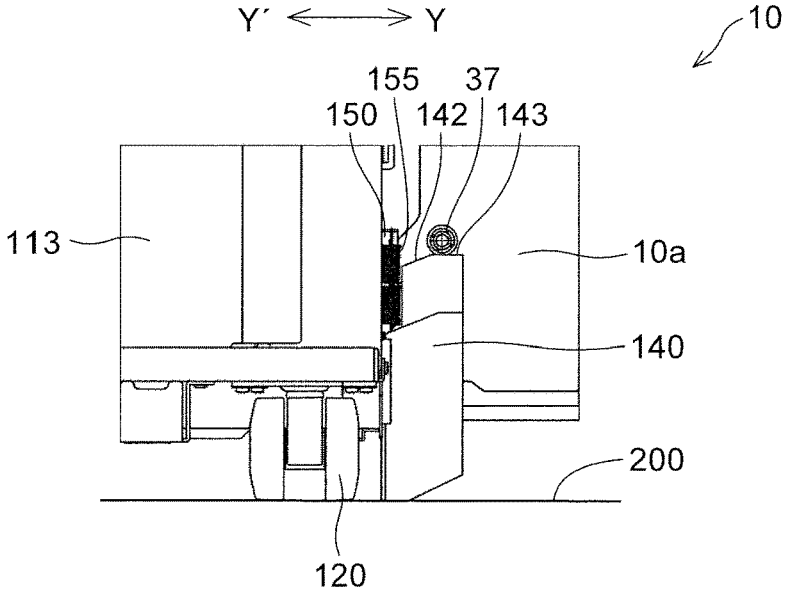
FIG. 9 is a side view showing s structure in a vicinity of the support member of the paper feed device of one embodiment of the present disclosure in the state where the first cassette is pulled out.

Furthermore, as shown in FIG. 7 and FIG. 9, an upper end of a biasing member 155 that is formed of an extension coil spring is mounted to an upper end of the guide member 150, and a lower end of the biasing member 155 is mounted to the support member 140. Thus, the support member 140 is biased upward by the biasing member 155.

In an upper end portion of the support member 140, there are formed an inclined surface 142 that is inclined upward toward a downstream side (the arrow Y direction) in the pull-out direction and a pressed surface 143 that is provided continuously with a downstream end of the inclined surface 142 in the pull-out direction (an end portion thereof in the arrow Y direction) and extends in a substantially horizontal direction.

The pressing portion 37 formed of a roller is rotatably mounted to each of respective opposed surfaces of the first cassette 10*a* and the second cassette 10*b* . The pressing portion 37 is disposed in a neighborhood of an end portion of each of the first cassette 10*a* and the second cassette 10*b* on an upstream side in the pull-out direction (the arrow Y' direction).

Figure 10:
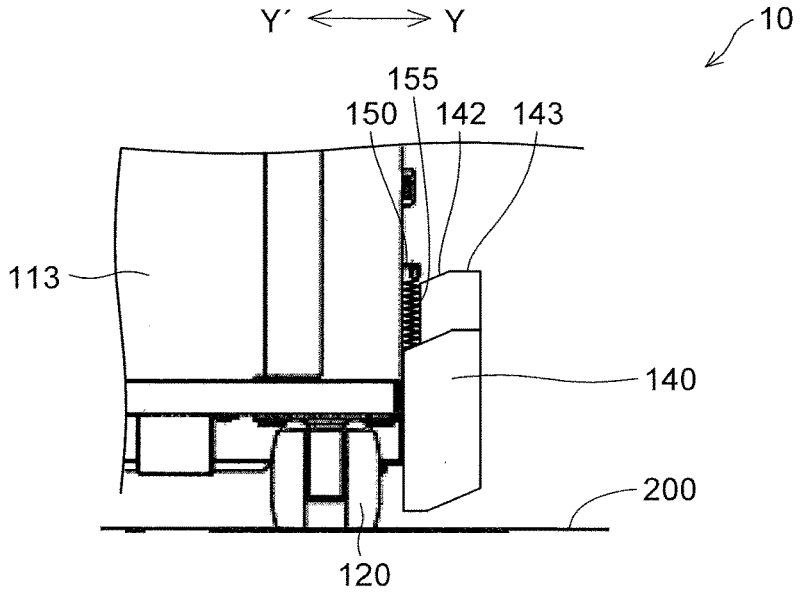
FIG. 10 is a side view showing a structure in a vicinity of the support member of the paper feed device of one embodiment of the present disclosure in a state where the first cassette is housed in a cassette housing portion.

In the paper feed device 10 of this embodiment, in a state where the first cassette 10*a* and the second cassette 10*b* are housed in the cassette housing portion 110*a* (a state shown in FIG. 2), the pressing portion 37 does not come into contact with the support member 140. Accordingly, as shown in FIG. 10, the support member 140 is disposed at a first position retracted upward by the biasing member 155. At this time, the first cassette 10*a* and the second cassette 10*b* are supported by the outer rails 130 and the inner rail 131, i.e. by the side surface portions 112 and 113, the front lower stay 116, and the rear lower stay 117 (see FIG. 5). An exterior cover having a handle formed thereon is provided on an outer surface of each of the first cassette 10*a* and the second cassette 10*b* on a downstream side in the pull-out direction (in the arrow Y direction), and thus the support member 140 cannot be seen from outside in a state where the first cassette 10*a* and the second cassette 10*b* are housed in the cassette housing portion 110*a* (a state shown in FIG. 10).

Furthermore, also in a state where at least one of the first cassette 10*a* and the second cassette 10*b* is in the middle of being inserted into/drawn out from the cassette housing portion 110*a* , the pressing portion 37 does not come into contact with the support member 140. Accordingly, the support member 140 is disposed at the first position retracted upward by the biasing member 55. At this time, the first cassette 10*a* and the second cassette 10*b* are supported by the outer rails 130 and the inner rail 131, i.e. by the side surface portions 112 and 113, the front lower stay 116, and the rear lower stay 117. With increasing pull-out amount of each of the first cassette 10*a* and the second cassette. 10*b* , a load applied to the rear lower stay 117 decreases, while a load applied to the front lower stay 116 increases.

Figure 11:
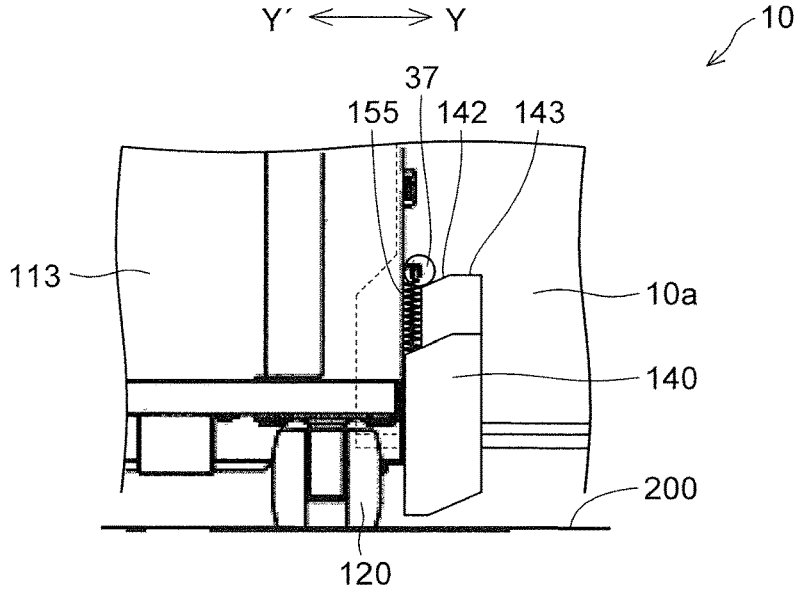
FIG. 11 is a side view showing a structure in a vicinity of the support member of the paper feed device of one embodiment of the present disclosure in a state immediately before pulling-out of the first cassette is completed.

On the other hand, as at least one of the first cassette 10*a* and the second cassette 10*b* (herein, the first cassette 10*a* ) is pulled out from the cassette housing portion 110*a* , as shown in FIG. 11, immediately before the pulling-out is completed, the pressing portion 37 comes into contact with the inclined surface 142 of the support member 140, thus causing the support member 140 to move downward against a biasing force of the biasing member 155. Then, in a state where the pulling-out of the first cassette 10*a* is completed (a state shown in FIG. 6), as shown in FIG. 9, the pressing portion 37 is positioned above the pressed surface 143, pressing the pressed surface 143 downward. In this state, the support member 140 is positioned at a second position where the support member 140 comes into contact with the floor surface 200.

At this time, a weight of a portion of the first cassette 10*a* on an outer side (the arrow X direction) is supported by the side surface portion 112 via the outer rail 130, and a weight of a portion of the first cassette 10*a* on an inner side (the arrow X' direction) is supported by the support member 140 via the pressing portion 37.

In this embodiment, as described above, in a state where the first cassette 10*a* and the second cassette 10*b* are housed in the cassette housing portion 110*a* , the support member 140 is disposed at the first position retracted upward. Thus, even in a case where the floor surface 200 is formed of a thick pile carpet or a case where protrusions are formed on the floor surface 200, in moving the paper feed device 10, the support member 140 can be prevented from colliding with the floor surface 200, and thus operability in moving the paper feed device 10 can be prevented from being deteriorated.

Furthermore, in a state where at least one of the first cassette 10*a* and the second cassette 10*b* is pulled out from the cassette housing portion 110*a* , the support member 140 is pressed downward by the pressing portion 37 so as to be disposed at the second position where the support member 140 is contactable with the floor surface 200. Thus, a weight of the inner-side portion of the at lease one of the cassettes pulled out from the cassette housing portion 110*a* can be supported by the support member 140. This can prevent a high load from being applied to the front lower stay 116, and thus even when the pulled-out at least one of the cassettes is replenished with a large quantity of sheets P, the front lower stay 116 can be prevented from being bent downward at a center portion thereof in the cassette width direction.

Furthermore, the front lower stay 116 can be prevented from being bent downward at the center portion thereof in the cassette width direction without the need to mount casters to a lower portion of each of the first cassette 10*a* and the second cassette 10*b* , and thus even when the floor surface 200 is formed of a thick pile carpet or when large depressions and projections are formed on the floor surface 200, operability in inserting/drawing out the first cassette 10*a* and the second cassette 10*b* can be inhibited from being deteriorated.

Furthermore, as described above, the guide member 150 is provided that guides the support member 140 so that the support member 140 is movable in the up-down direction, and thus the support member 140 can be easily moved in the up-down direction.

Furthermore, as described above, the biasing member 155 is provided that biases the support member 140 upward, and thus in a state where the first cassette 10*a* and the second cassette 10*b* are housed in the cassette housing portion 110*a* , the support member 140 can be easily disposed at the first position.

Furthermore, as described above, the support member 140 has the inclined surface 142 that is inclined upward toward the downstream side in the pull-out direction and the pressed surface 143 that is provided continuously with the downstream end of the inclined surface 142 in the pull-out direction and is pressed downward by the pressing portion 37. Thus, when at least one of the first cassette 10*a* and the second cassette 10*b* is pulled out, the support member 140 can be easily moved downward by the pressing portion 37, and in a state where at least one of the first cassette 10*a* and the second cassette 10*b* is pulled out from the cassette housing portion 110*a* (a state shown in FIG. 9), the support member 140 can be easily pressed downward by the pressing portion 37.

Furthermore, as described above, the pressing portion 37 is formed of a roller. Thus, the pressing portion 37 moves in the cassette pull-out direction and the cassette insertion direction (the arrow Y' direction) while rotating in a state of being in contact with the inclined surface 142 and the pressed surface 143, so that frictional resistance between the pressing portion 37 and the support member 140 can be reduced. This can further prevent operability in inserting/drawing out the first cassette 10*a* and the second cassette 10*b* from being deteriorated.

The embodiment disclosed herein is to be construed in all respects as illustrative and not limiting. The scope of the present disclosure is indicated by the appended claims rather than by the foregoing description of the embodiment, and all changes that come within the meaning and range of equivalency of the claims are intended to be embraced therein.

For example, while the foregoing embodiment has explained that a position where the support member 140 comes into contact with the floor surface 200 is defined as the second position, the present disclosure is not limited thereto. For example, a configuration may also be adopted in which, in a state where pulling-out of an empty cassette having no sheets P stacked thereon is completed, a lower end of the support member 140 is disposed so as to be spaced by a small distance (for example, several millimeters) from the floor surface 200. In this case, a configuration may also be adopted in which a prescribed or higher quantity of sheets P are stacked on the cassette thus pulled out, causing the front lower stay 116 to sag down a small distance (for example, several millimeters), so that the lower end of the support member 140 comes into contact with the floor surface 200, and thus the support member 140 supports the cassette.

Furthermore, while the foregoing embodiment has shown an example in which the biasing member 155 is provided that biases the support member 140 upward, the present disclosure is not limited thereto. A configuration may also be adopted in which each of the first cassette 10*a* and the second cassette 10*b* is provided with a push-up piece or the like (an engagement portion) for moving the support member 140 upward.

Figure 12:
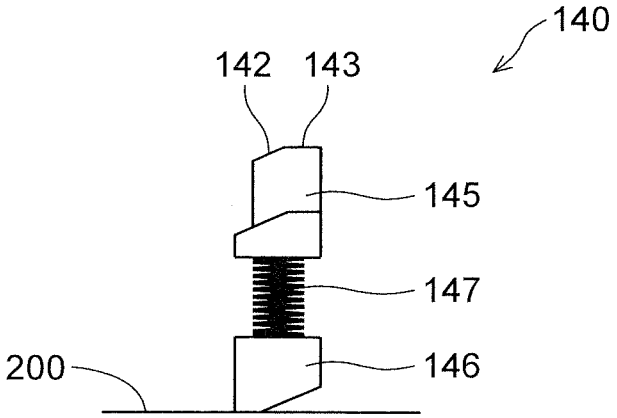
FIG. 12 is a side view showing a structure of a support member of a paper feed device as a modification example of the present disclosure.

Furthermore, the support member 140 may be configured, for example, as in a modification example of the present disclosure shown in FIG. 12. Specifically, the support member 140 may be composed of a pressed portion 145 that is pressed by the pressing portion 37, a contact portion 146 that is disposed below the pressed portion 145 and is contactable with the floor surface 200, and a compression spring 147 that is disposed between the pressed portion 145 and the contact portion 146. This configuration is particularly effective in a sense that, even when depressions and projections are formed on the floor surface 200 below the support member 140, the depressions and projections of the floor surface 200 are absorbed by expansion and contraction of the compression spring 147, so that an influence of the floor surface 200 on the support member 140 can be eliminated. As the compression spring 147, there may be used a highly resilient spring that can support a load from each of the first cassette 10*a* and the second cassette 10*b*.

Furthermore, a configuration obtained by appropriately combining the foregoing embodiment with the modification example is also encompassed in the technical scope of the present disclosure.

What is claimed is:

1. A paper feed device, comprising:

a first cassette and a second cassette that each house a plurality of sheets in a stacked state and are arranged side by side in a cassette width direction;

a casing that includes:

an opening portion through which the first cassette and the second cassette are inserted/drawn out; and a cassette housing portion in which the first cassette and the second cassette are housed;

a support member that is disposed at a center portion of the opening portion in the cassette width direction and is capable of supporting the first cassette and the second cassette; and a guide member, wherein the casing has a stay that is disposed in a lower portion of the opening portion and extends in the cassette width direction, each of the first cassette and the second cassette is provided with a pressing portion that presses the support member downward, the support member is movable in an up-down direction, and in a state where the first cassette and the second cassette are housed in the cassette housing portion, the support member is disposed at a first position retracted upward, while in a state where at least one of the first cassette and the second cassette is pulled out from the cassette housing portion, the support member is pressed downward by the pressing portion so as to be disposed at a second position where the support member is contactable with an installation surface on which the casing is installed, and the guide member is secured at a center portion of the stay in the cassette width direction and guides the support member so that the support member is movable in the up-down direction.

2. The paper feed device according to claim 1, wherein the support member is composed of:

a pressed portion that is pressed by the pressing portion;

a contact portion that is disposed below the pressed portion and is contactable with the installation surface; and a compression spring that is disposed between the pressed portion and the contact portion.

3. An image forming apparatus, comprising:

the paper feed device according to claim 1; and an image forming portion.

4. A paper feed device, comprising:

a first cassette and a second cassette that each house a plurality of sheets in a stacked state and are arranged side by side in a cassette width direction;

a casing that includes:

an opening portion through which the first cassette and the second cassette are inserted/drawn out;

a cassette housing portion in which the first cassette and the second cassette are housed;

a support member that is disposed at a center portion of the opening portion in the cassette width direction and is capable of supporting the first cassette and the second cassette; and a biasing member that biases the support member upward, wherein the casing has a stay that is disposed in a lower portion of the opening portion and extends in the cassette width direction, each of the first cassette and the second cassette is provided with a pressing portion that presses the support member downward, and the support member is movable in an up-down direction, and in a state where the first cassette and the second cassette are housed in the cassette housing portion, the support member is disposed at a first position retracted upward, while in a state where at least one of the first cassette and the second cassette is pulled out from the cassette housing portion, the support member is pressed downward by the pressing portion so as to be disposed at a second position where the support member is contactable with an installation surface on which the casing is installed.

5. The paper feed device according to claim 3, wherein the support member is composed of:

a pressed portion that is pressed by the pressing portion;

a contact portion that is disposed below the pressed portion and is contactable with the installation surface; and a compression spring that is disposed between the pressed portion and the contact portion.

6. An image forming apparatus, comprising:

the paper feed device according to claim 4; and an image forming portion.

7. A paper feed device, comprising:

a first cassette and a second cassette that each house a plurality of sheets in a stacked state and are arranged side by side in a cassette width direction;

a casing that includes:

an opening portion through which the first cassette and the second cassette are inserted/drawn out; and a cassette housing portion in which the first cassette and the second cassette are housed; and a support member that is disposed at a center portion of the opening portion in the cassette width direction and is capable of supporting the first cassette and the second cassette, wherein the casing has a stay that is disposed in a lower portion of the opening portion and extends in the cassette width direction, each of the first cassette and the second cassette is provided with a pressing portion that presses the support member downward, the support member is movable in an up-down direction, and in a state where the first cassette and the second cassette are housed in the cassette housing portion, the support member is disposed at a first position retracted upward, while in a state where at least one of the first cassette and the second cassette is pulled out from the cassette housing portion, the support member is pressed downward by the pressing portion so as to be disposed at a second position where the support member is contactable with an installation surface on which the casing is installed, and the support member includes:

an inclined surface that comes into contact with the pressing portion and is inclined upward toward a downstream side in a pull-out direction of each of the first cassette and the second cassette; and a substantially horizontal pressed surface that is provided continuously with a downstream end of the inclined surface in the pull-out direction and is pressed downward by the pressing portion.

8. The paper feed device according to claim 7, wherein the pressing portion is formed of a roller that is movable in the pull-out direction and an insertion direction while rotating in a state of being in contact with the inclined surface and the pressed surface.

9. The paper feed device according to claim 7, wherein the support member is composed of:

a pressed portion that is pressed by the pressing portion;

a contact portion that is disposed below the pressed portion and is contactable with the installation surface; and a compression spring that is disposed between the pressed portion and the contact portion.

10. An image forming apparatus, comprising:

the paper feed device according to claim 7; and an image forming portion.

* * * * *